United States Patent [19]

Ferguson

[11] Patent Number: 4,760,994

[45] Date of Patent: Aug. 2, 1988

[54] DEVICE FOR A WELDING TORCH

[76] Inventor: Charles L. Ferguson, 931 Westview Dr., Louisville, Ky. 40214

[21] Appl. No.: 824,672

[22] Filed: Jan. 31, 1986

[51] Int. Cl.[4] ..... B23K 7/00

[52] U.S. Cl. ..... 266/48; 266/74

[58] Field of Search ..... 266/48, 74, 75; 239/289, 559

[56] References Cited

U.S. PATENT DOCUMENTS 4,062,495 12/1977 Lück ..... 266/48

4,093,191 6/1978 Ferguson ..... 266/48

*Primary Examiner*—John P. Sheehan

*Assistant Examiner*—S. Kastler

*Attorney, Agent, or Firm*—Edward M. Steutermann

[57] ABSTRACT

A safety arrangement useful in burning and cutting torches and like devices wherein the torch utilizes an oxidizer medium and a fuel which is supplied to the torch at selected pressure and where the fuel and oxidizing medium are independently provided to the torch and mixed therein where the present invention includes a valve assembly having two spool valves moveable within the valve assembly and where the valve assembly receives the oxidizer media, the fuel media, and a extinguisher medium which is supplied at least a selected pressure to hold the spool valve assembly in a first mode so that oxidizer means and fuel medium can be supplied through the valve assembly to the torch and where upon reduction of the pressure of the extinguisher medium below a selected pressure the valve assembly reverts to a second mode and where the flow of oxidizer medium and the flow of fuel medium are shut off and where in the event of a fire the spool assembly can be moved to the second mode and the extinguisher medium supplied through the torch to extinguish the fire.

6 Claims, 3 Drawing Sheets

DEVICE FOR A WELDING TORCH

BACKGROUND OF THE INVENTION

The present invention relates generally to devices for use in connection with welding apparatus and more particularly for use in connection with welding or cutting apparatus utilizing a torch in which a fuel medium such as a acetylene and oxygen are mixed and burned at the tip of the torch to perform useful work. Conventional cutting or burning torches of the type anticipated hereby have found wide application in industry and especially in the metal working industries. Since such welding apparatus utilizes highly combustible fuel in combination with a supporting medium such oxygen the resulting combustion generates excessive amounts of heat. In situations where metal working is occurring at various times burning pieces of metal are broken away from the working area and can ignite combustible material. In other arrangements other types of unwanted combustion can occur in association with a welding or cutting operation. Heretofore, except as noted hereinafter, it has been necessary for an operator to have on location a fire extinguisher device when the possibility of unwanted combustion exists. Even in such cases the time required for the operator to terminate the operation of the welding torch and to secure the fire extinguisher and initiate operation of the fire extinguisher can comsume enough time to allow significant damage to occur from the unwanted conflagration. In prior applications where the possibility of fire is not recognized the time required for the operator to secure a fire extinguisher and put out a fire can be a disastrous and in some instances result in even fatalities.

U.S. Pat. No. 4,093,191 describes one means for substantially lessing the likelihood of any damage occurring from unexpected or unwanted fires in an area in which cutting or welding is being accomplished. Devices provided in accordance with the aforenoted patent work quite satisfactorily for the purpose for which they are intended and the present invention relates to additional features, embodiments and improvements thereon.

SUMMARY OF THE INVENTION

The present invention broadly anticipates the use of devices for extinguishing fires at welding location where source of the fire extinguishing medium is integral with the welding torch. The present invention provides certain advantageous over the arrangements shown in U.S. Pat. No. 4,093,191 in terms of characteristics and to facilitate manufacture of the device as well as improve the characteristics of the operation of the device shown in the aforenoted U.S. Patent. As in the case of U.S. Pat. No. 4,093,191 the present invention contemplates an arrangement where the supply of fuel and oxidizer to the welding torch is interlocked with and controlled by the availabilty of fire extinguishing medium.

Likewise the present invention provides a welding torch assembly which can be utilized to immediately terminate the operation of the fuel and oxidizer at the torch and to supply fire extinguishing medium through the torch head in one simple movement by the operator so that in the event of the occurrence of an unwanted fire the extinguishing operation begins virtually immediately and can proceed till complete.

Briefly, the present invention provides a safety arrangement useful in burning and cutting torches and like devices wherein the torch utilizes an oxidizer medium and a fuel which is supplied to the torch at selected pressure and where the fuel and oxidizing medium are independently provided to the torch and mixed therein where the present invention includes a valve assembly having two spool valves moveable within the valve assembly and where the valve assembly receives the oxidizer medium, the fuel medium, and a extinguisher medium which is supplied at least a selected pressure to hold the spool valve assembly in a first mode so that oxidizer means and fuel medium can be supplied through the valve assembly to the torch and where upon reduction of the pressure of the extinguisher medium below a selected pressure the valve assembly reverts to a second mode and where the flow of oxidizer medium and the flow of fuel medium are shut off and where in the event of a fire the spool assembly can be moved to the second mode and the extinguisher medium supplied through the torch to extinguish the fire.

Examples of one arrangement within the scope of the present invention are illustrated in the accompanying drawings and described hereinafter but it will be understood that the arrangement shown herein are by way of illustration only and not by way limitation.

DETAIL DESCRIPTION OF THE DRAWINGS

Figure 1:
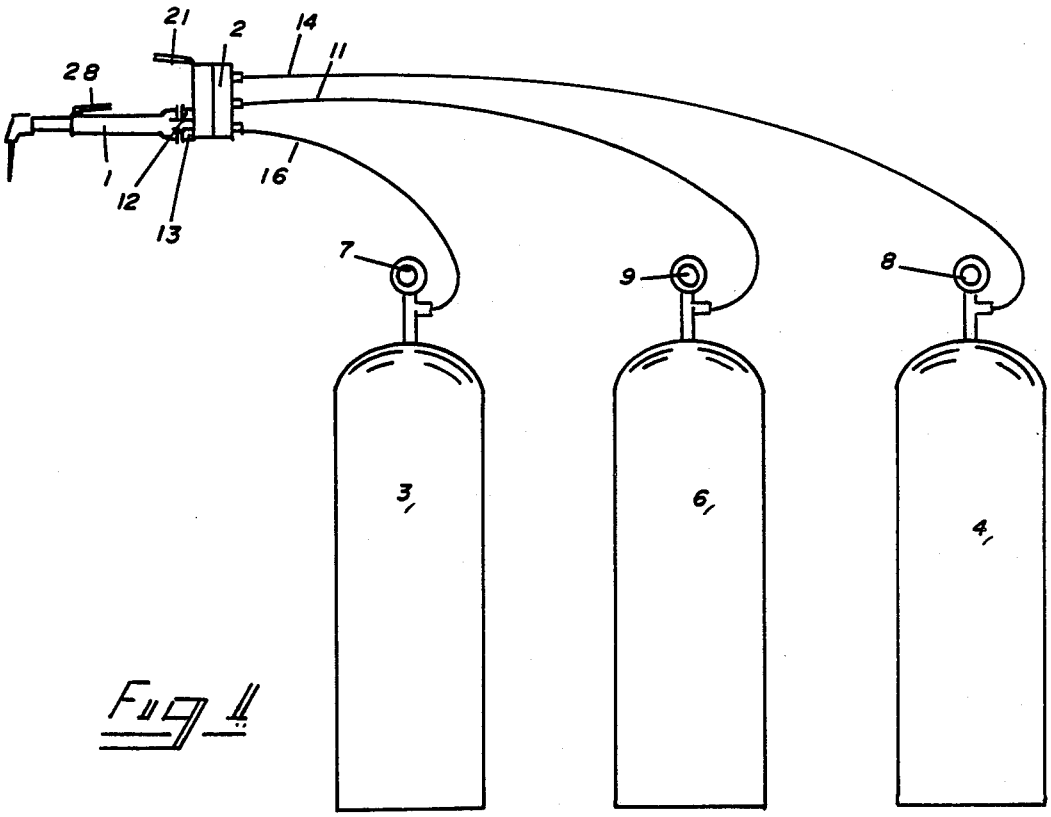
FIG. 1 is an illustration of system for use of a device within the scope of the present invention.

Referring first to FIG. 1 which shows an illustration of a welding assembly as is known in the art and also shows a welding safty apparatus in accordance with the present invention, a welding torch 1 for cutting or welding and adapted to utilized a selected fuel, for example a acetylene and a oxidizer material, for example oxygen where the fuel is supplied through an inlet 13 and the oxidizer is supplied through an inlet 12. As also described hereinafter a extinguishing medium can be selectively supplied through one of the inlets 12 or 13.

As is known in the art a pressurized source of a acetylene, for example an acetylene tank 3 is provided having a pressure regulator 7 to adjust the pressure at an outlet 16 of the regulator where the outlet is connected to an inlet of a valve assembly 2 within the scope of the present invention as described hereinafter.

An oxygen tank 6 is also provided having a regulator 9 to adjust the pressure of oxygen supplied at an outlet 11 to the valve assembly 2.

Within the scope of the present invention a pressurized fire extinguisher, for example a Halon TM tank is provided and can have a pressure regulator 8 to supply the extinguisher medium through outlet 14 to the valve assembly 2.

Thus, it will seen that the oxidizer and fuel pass through the valve assembly as does the fire extinguisher.

Figure 3:
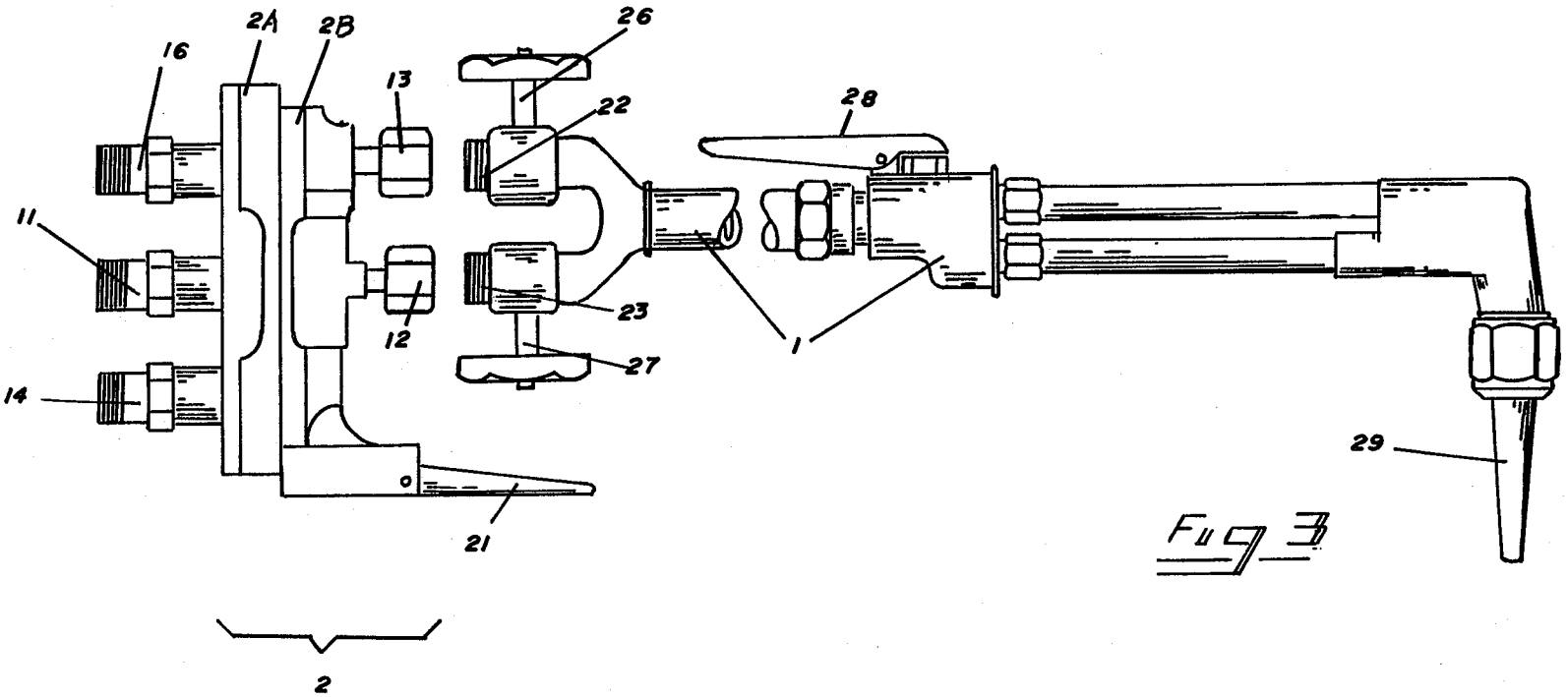
FIG. 3 is a perspective view of an example of an assembled device within the scope of the present invention.

An enlarged view of the an example of a valve assembly and welding torch are shown in FIG. 3, where it can be seen that the valve assembly 2 has a lever arm 21 and a body composed of valves body halves 2A, 2B where the connections 11, 16, and 14 are provided on the valve half a 2A outlets 12, and 13 are provided on the valve half 2B. Hoses as shown are provided to be connected to the ports and the outlets 12, and 13 are provided with connectors adapted to be connected to inlets 22, and 23 of the valve member 1 as is known in the art. Adjustment knobs 26, and 27 can be provided to adjust the flow of the oxygen and acetylene through the torch. A shutoff valve 28 can likewise be provided to terminate the flow of both the oxygen and acetylene to the torch tip 29 all is as known in the art. The siginificant point in FIG. 3 is the third inlet 14, which is utilized to supply fire extinguisher to the valve device and lever 21 which is utilized to terminate the flow of oxygen and acetylene through the valve assembly and simultaneously initiate the flow of extinguisher through the inlet 14 when the torch is in operation.

Figure 4A:
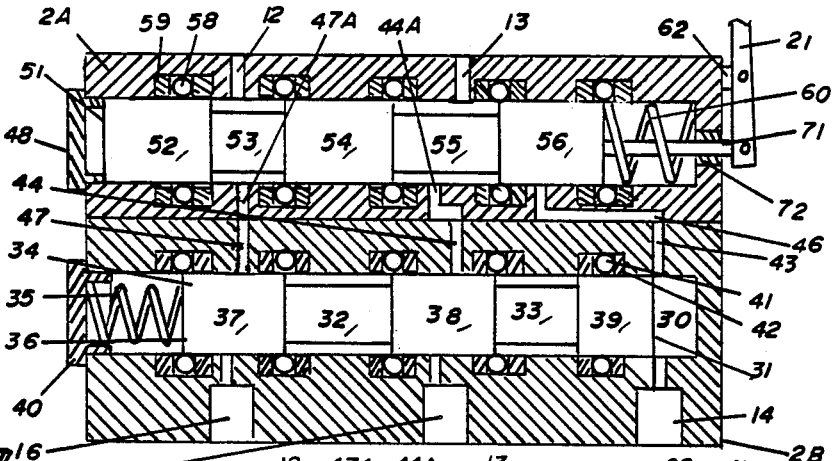
FIG. 4A–4C illustrate schematically various modes of operation of a device within the scope of the present invention.
Figure 4B:
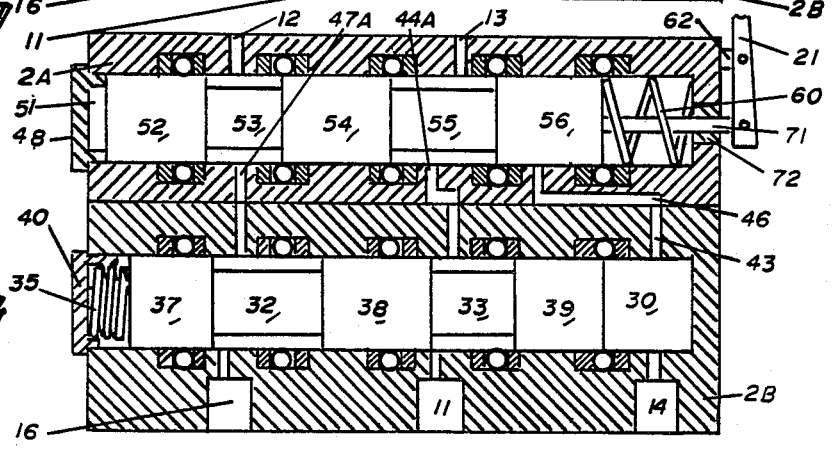
Figure 4C:
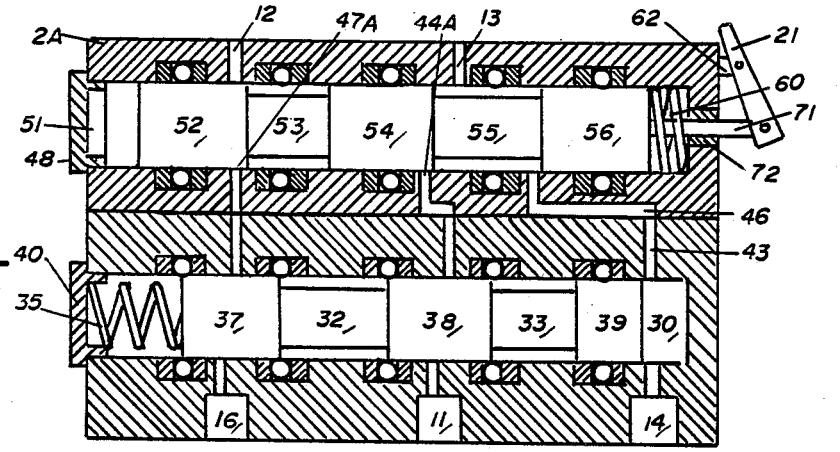

Referring to FIGS. 4A, 4C which provide a schematic description of operation of devices within the scope of the present invention attention is directed first to FIG. 2 which is an illustration of a spool valve member which can be utilized in devices in accordance with the present invention as described with reference to FIGS. 4A–4C.

The example of the device within the scope of the present invention described herein utilizes a spool valve assembly but it will be understood that devices within the scope of the present invention are not limited to use of such devices but can, however, be adapted to use various other types of valve assemblies.

Figure 2:
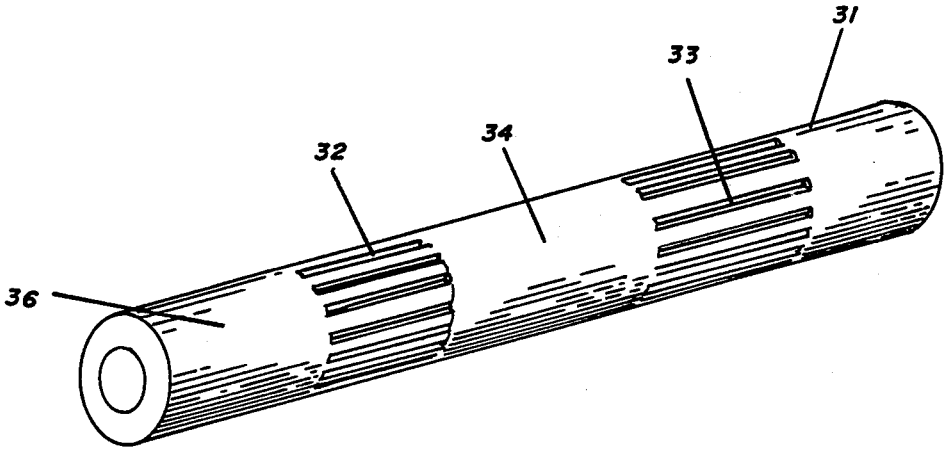
FIG. 2 is an illustration of a perspective view of one spool valve arrangement within the scope of the present invention.

In the arrangement shown in FIG. 2 a spool 31 is provided and has parallel grooves 32, 33, cut longitudinally around the circumference of the spool. It has been found that in applications associated with the present invention such an arrangement is particularly useful to allow the spool to be positioned with an "O" ring, which would normally be use to seal on the solid portions of the spool such as portion 34, by moving the spool piece into the area of the "O" ring cross flow is allowed through the grooves 32 but the wear on the "O" ring assembly is reduced because the "O" ring does not continually contact the entire sealing surface as spool moves back to the sealing relation but rather the "O" ring is held substantially open throughout the entire operation.

It will also be noted that in the arrangement shown in FIG. 2 a bore 36 is provided in one end of the spool which is utilized as described hereinafter.

Referring now FIG. 4A–4C shows which show schematically, a cross section, one example of a valve arrangement within the scope of the present invention to regulate the flow of a acetylene and oxidizer to a welding torch as described hereinbefore and also to provide means for the flow of a fire extinguisher material, the valve assembly has 2A and 2B representing the valve assembly as previously described are shown. Inlets 11, 14, and 16 are shown respectively to receive the oxygen, fuel, and extinguisher material.

A spool valve 31 similar to the one shown in FIG. 2 is provided in a chamber 30 within valve half 2B to move longitudinally therein. Spool 31 is biased in one direction by means of compression spring 35 of selected spring constant as described hereinafter where the end of the spring is received in a recess in a cap 40 which is provided to close the end of chamber 30 and to retain the spring member in aligned relation with the spool 31. One end of spool 31 can be received in the pore 36 of spool piece 31 as shown in FIG. 2.

The extinguisher material admitted through inlet port 14 to the portion of chambers 30 outboard of the sealing surface 39 of the valve member 31. It will be noted that the sealing surfaces 37, and 38 are also shown and that the fluted sections 32, 33 are shown with root section exposed to better illustrate flow of gases through the device in accordance with the present invention.

The arrangements shown in FIG. 1 further includes the valve half 2A where also as shown outlets 47 and 44 are provided from the valve half 2B. The outlets 47, and 44 from the valve half 2B communicating with inlets 47A, 44A of valve 2A where offsets 46 and 44A are provided to provide the proper inlet orientation from the valve half 2B, the outlet 43 being provided from the end of chamber 30 as shown. Thus, there are three inlets to the valve half 2A and two outlets 12 and 13 as shown in FIG. 3. Outlets 12 and 13 communicate with the torch assembly as previously described. A spool valve assembly 51 is provided in a chamber 70 within the body 2A to move longitudinally therein and a spring 57 is provided at one end of the spool assembly to engage the end as shown. As also shown, the spool assembly 51 includes sealing areas 52, 54, and 56 with intermediate fluted areas 53, 55 similar to the fluted areas 32, 33 provide as previously described with reference to spool 31.

A rod 71 is connected to the end 56 of spool 51 and passes through a seal 72 so that spool 51 can be moved longitudinally within the chamber defined within housing 2A. A cap 48 is provided to close the end of the chamber.

A lever 21 shown in FIG. 3 is connected to the rod 71 to facilitate movement of the spool 51 within the chamber where it will be understood that spring 57 biases the spool piece to the position shown in FIG. 4A in which the sealing area 52 resting against the end cap 48.

FIG. 4A is an illustration of the orientation of the elements of a device within the scope of the present invention when there is insufficient extinguisher pressure at the inlet 14 to move the spool piece 31 against the force exerted by the spring 35. Such an arrangement provides an aspect of safty in that if there is insufficient extinguisher pressure the outlets 47 and 44 from the valve half 2B are closed so that oxidizer and fuel cannot flow from the inlets 11, and 16 to the torch.

FIG. 4B illustrates an arrangement where sufficient oxidizer pressure has been achieved at the inlet 14 to move the spool piece 41 against the force exerted by the spring 35 so that the outlets 44 and 46 are open to admit flow through to the outlets 12, and 13 and normal welding or cutting operations can occur.

It will be further noted that in each case "0" ring 41 are provided in valve body 2B with spacers 42 on each side thereof and that "0" rings 58 are provided in the valve assembly 2A with spacers 59 on either side thereof.

In FIG. 4B the valve assembly has moved to a position where flow is allowed but no extinguisher flow is permitted because of the positioning of the sealing surface 56 of the spool piece 51.

Referring now to FIG. 4C which illustrates an arrangement where, for example, a fire has been initiated and flow of extinguisher material is desired the spool 51 is withdrawn by movement of the lever 21 so that the sealing surface 56 has moved away from the outlet 46 from valve half 2B. Upon the initiation of the flow of extinguisher material the pressure in the portion of chamber 30 adjacent the end 39 is reduced so that the spool piece 31 reverts to the position shown in FIG. 4A blocking the flow of oxygen and acetylene and the extinguisher material is allowed to flow through the chamber 30 into the valve body 2A and through the flutes provided by the segments 55 of spool 51 and beneath the "0" ring 58 in that area and through the outlet 13 which is normally utilized for the one of the combustible components utilized in the device. In this regard it will be noticed that spring 57 has been compressed by the movement of lever 21 to allow movement of the spool 51 and that the flow of the extinguisher has terminated.

Thus, it will be seen that devices within the scope of the present invention accommodates situations both where there is insufficient extinguisher pressure to fight a fire and where a fire has occurred and it is necessary to immediately commence to put the fire out.

It will be understood that the foregoing are but a few examples of arrangements within the scope of the present invention and features thereof and that various other features and arrangements also within the scope of the present invention will occur to those skilled in the art upon reading the disclosure set forth hereinafter.

The invention claimed is:

1. An arrangement useful in fuel burning torches utilizing an oxidizer and a fuel each supplied to said torch at selected pressure and mixed therein including valve assembly means having first and second chambers; first and second spool valves each located in, and moveable within said first and second chambers respectively where said first chamber has inlet means to receive said oxidizer and said fuel; and fuel outlet means and oxidizer outlet means fire extinguisher supply means to supply fire extinguisher at a selected pressure to said first chamber to hold said first spool valve in a first mode so that said oxidizer means and fuel medium are supplied through said first chamber and said fuel outlet and said oxidizer outlet to said second chamber and to said torch; and bias means located in said first chambers so upon reduction of pressure of said extinguisher medium below a selected pressure said first valve means is moved to a second mode where flow of oxidizer and flow of fuel through said second chamber are terminated wherein said second chamber includes bias means to bias said second valve to first position to allow flow of oxidizer and fuel through said second chamber to said torch, and lever means, to move said spool assembly to second position wherein flow of oxidizer and fuel is terminated and said extinguisher medium is supplied from said first chamber through said second chamber to said torch and wherein each of said spool valve means includes solid portions to be moved in alignment with said fuel and oxidizer inlet and outlet means to block flow of fluid through said first and second chambers and include at least one segment having longitudinally extending grooves which, when in alignment with said inlet means and outlets in said first and second chamber allow flow of said selected oxidizer medium, fuel, and extinguisher medium through said chamber.

2. The invention of claim 1 wherein said first and second valve means are spool valve means having and first and second chambers are tubular chambers where said first and second valve means are received within said first and second tubular chambers to move longitudinally therein to allow flow of said oxidizer medium, said fuel and said extinguisher medium through said first and second chambers in accordance with the position of said first and second valve members.

3. The invention of claim 2 including connector means wherein said fuel, and oxidizer medium, is supplied to said first chamber by independent connector means.

4. The invention of claim 3 wherein said connector means includes dual outlet means connected to cooperative dual inlet means provided by said torch whereby when said extinguisher medium is to be supplied through said valve assembly said extinguisher medium flows from said first chamber into said second chamber and flows through the outlet from said second chamber normally utilized to supply fuel to the torch means.

5. The invention of claim 4 wherein said torch means includes third valve means adapted to terminate the flow of oxygen and fuel to said torch.

6. The invention of claim 5 in said bias means in said first chamber is coil spring means having a spring constant selected in accordance with the surface area of the end of said first spool valve means to hold said first valve in said first mode in response to a selected extinguisher pressure and to allow said spool valve to move to said second mode in response to a decrease in said extinguisher medium pressure below said selected value.

* * * * *